United States Patent [19]

Bettenhausen

[11] 4,315,608

[45] Feb. 16, 1982

[54] TAPE MANDREL

[75] Inventor: Larry A. Bettenhausen, Stillwater, Minn.

[73] Assignee: Minnesota Mining & Manufacturing Company, St. Paul, Minn.

[21] Appl. No.: 189,082

[22] Filed: Sep. 22, 1980

[51] Int. Cl.[3] ..... B65H 17/02

[52] U.S. Cl. ..... 242/68; 242/68.4

[58] Field of Search ..... 242/68, 68.1, 68.4, 242/68.5, 35, 129.51; 33/127; 206/389

[56] References Cited

U.S. PATENT DOCUMENTS

| | | | |
|---|---|---|---|
| 1,055,576 | 3/1913 | Tyler | 242/68.5 |
| 2,414,893 | 1/1947 | Peterson | 242/68.4 |
| 3,297,155 | 1/1967 | Gattenby | 242/68.5 |
| 4,191,342 | 3/1980 | Reinhold | 242/68.5 |

*Primary Examiner*—Edward J. McCarthy

*Attorney, Agent, or Firm*—Cruzan Alexander; Donald M. Sell; John C. Barnes

[57] ABSTRACT

A mandrel which, when inserted into the inner cylindrical surface of a tape roll core, permits the core to be rotatably mounted in a dispenser. The mandrel has two generally triangular opposed end plates connected at corresponding corners by three arcuate plates. Each end plate has a cylindrical stub shaft extending outward perpendicularly to define the axis of the mandrel. The arcuate plates are spaced to define segments of a cylinder coaxial with the axis of the mandrel. Each arcuate plate has a rib extending axially along its convex surface; when the mandrel is inserted into a tape roll core, these ribs engage the inner cylindrical surface of the core. A mandrel of this structure is particularly suited for manufacture by an injection molding process.

3 Claims, 8 Drawing Figures

PRIOR ART

TAPE MANDREL

BACKGROUND

1. Field of the Invention

This invention relates to a molded plastic mandrel of the type which is inserted into the hollow cylindrical center of a core containing convolutely wound material, the mandrel has an axle which affords mounting and rotation of the core and mandrel assembly in a dispensing device.

2. Description of the Prior Art

Known mandrels generally have a cylindrical body with an outer cylindrical surface to engage the core and have a center axle for engaging opposed recesses in the walls of a dispensing device, the center axle being of greater axial length than the cylindrical body. When known mandrels are manufactured at low cost as a unitary piece in an injection molding process, the parting plane of the two mold halves is generally perpendicular to the axis of the mandrel. Although this affords some material savings by providing a hollow area in a portion of the cylinder body between the center axle and the outer cylindrical surface, the center axle has plastic material thoughout its length. The present invention affords a substantial reduction in plastic material by eliminating the axle portion within the cylinder body, and retains the ability to be manufactured by an injection molding process.

SUMMARY OF INVENTION

The present invention provides a mandrel that is inserted in the hollow cylindrical portion of a core containing convolutely wound material, with the mandrel engaging the inner cylindrical surface of the core to be mounted and rotated in a dispensing device. The objective of this invention is to provide a mandrel which uses substantially less plastic material than known mandrels and which can be manufactured by an injection molding process.

The mandrel according to this invention has two generally triangular opposing end plates and has its axis defined by a pair of cylindrical stub shafts, with one stub shaft projecting perpendicularly from the outer end face of each end plate. Arcuate plates which define segments of a cylinder coaxial with the axis of the mandrel connect corresponding corners of the triangular end plates. Each arcuate plate has a rib extending axially along its convex surface, with the ribs being spaced at an equal radial distance from the axis of the mandrel. When the mandrel is inserted in a core, the ribs engage the inner cylindrical surface of the core.

By placing the mold parting line through the axis of the mandrel and having the mold opening direction perpendicular to the axis, the mandrel may be manufactured by a plastic injection molding process with a trough shaped cavity defined by the end plates and arcuate plates. A mandrel provided with this trough shaped cavity requires substantially less plastic to manufacture than known mandrels.

BREIF DESCRIPTION OF THE DRAWINGS

The present invention will be further described with reference to the accompanying drawings wherein like numerals refer to like parts through the several views and wherein.

DETAILED DESCRIPTION OF INVENTION

Figure 1:
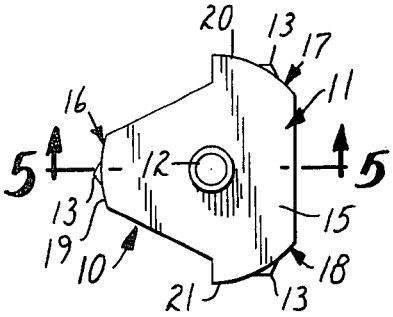
FIG. 1 is end view of a mandrel according to the present invention.
Figure 3:
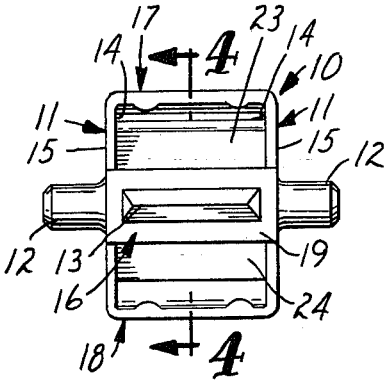
FIG. 3 is a front view of the mandrel of FIG. 1.
Figure 2:
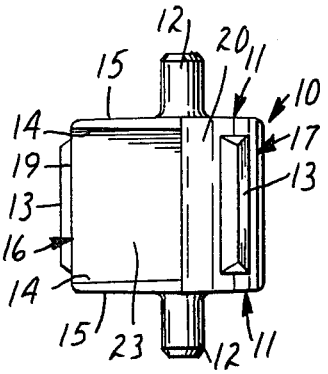
FIG. 2 is a top view of the mandrel of FIG. 1.
Figure 4:
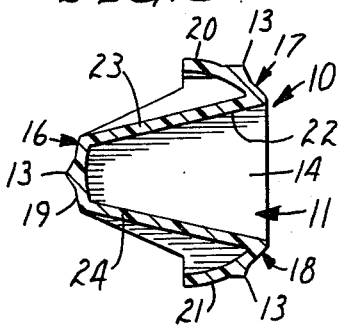
FIG. 4 is a sectional view taken approximately along line 4—4 of FIG. 3.
Figure 5:
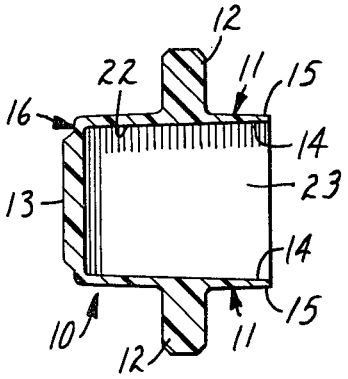
FIG. 5 is a sectional view taken approximately along line 5—5 of FIG. 1.

Referring to the drawings, there is illustrated a mandrel according to the present invention generally designated by the reference numberal 10.

Figure 6:
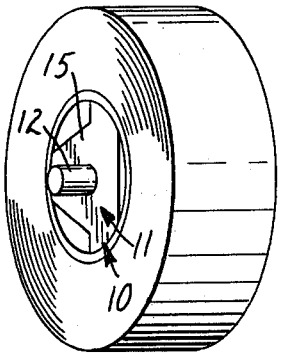
FIG. 6 is a perspective view of the mandrel of FIG. 1, and which additionally shows the mandrel assembled into a tape roll core.
Figure 7:
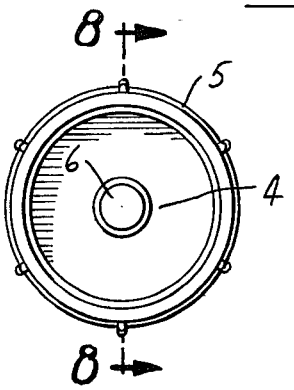
FIG. 7 is a end view of a prior art mandrel.
Figure 8:
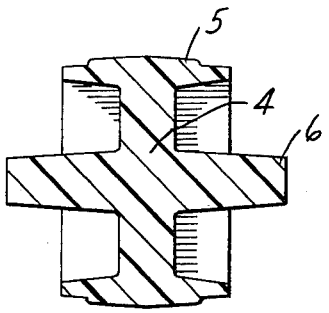
FIG. 8 is a sectional view taken approximately along line 8—8 of FIG. 7.

The mandrel 10 is a unitary molded plastic device which supports a core containing convolutely wound material. An operative example is a mandrel 10 used to support a tape roll core (FIG. 6); by inserting the mandrel on the inner cylindrical surface of the tape roll core, the core may be rotatably mounted in a pull-and-tear desk type tape dispenser or similar dispensing device. The mandrel 10 has a body with three axially extending ribs 13 for engagement with the inner cylindrical surface of a core, and has two cylindrical stub shafts 12 projecting from the body for engagement in opposed recesses in the walls of a dispensing device. The stub shafts 12 are aligned to define the axis of the mandrel and are of equal length to center the core in the dispenser.

The mandrel body further includes two spaced parallel generally triangular end plates 11 having opposed faces 14 and outer end faces 15. The corners of the plates 11 are truncated. One of the cylindrical stub shafts 12 projects perpendicularly from the outer end face 15 of each end plate 11. The stub shafts provide the bearing surface by which the mandrel is mounted and rotated in a dispensing device. The end plates are joined by three arcuate plates 16, 17, 18 connecting corresponding truncated corners of the end plates 11. The arcuate plates define segments of a cylinder coaxial with the axis of the mandrel. Each arcuate plate 16, 17, 18 has one rib 13, extending axially along its convex surface 19, 20, 21. The ribs 13 are spaced at an equal radial distance from the axis of the mandrel. As the mandrel 10 is inserted in a core, the ribs 13 engage the inner cylindrical surface of the core at equal arcuately spaced positions.

To strengthen the body of mandrel 10, two diverging walls 23, 24 extend between the end plates 11 and diverge from opposing edges of the arcuate plate 16. The walls 23 and 24 are then joined to the adjacent edges of arcuate plates 17 and 18 respectively, said adjacent edges being the edges furthest from said opposing edges of arcuate plate 16. The walls 23 and 24 and plate 16 thus define a large trough shaped cavity 22 between the end plates 11.

In order to afford balanced support for the core, the ribs 13 may be equally spaced about the circumference of the mandrel.

A common low cost method of manufacturing the mandrel 10 is by an injection molding process. The mandrel 10 is formed by injecting plastic material into a mold. When the material has cooled and hardened, the mandrel 10 is released from the mold by having the mold separate into two halves, and having the mandrel 10 pushed out by ejection pins located in the mold. After the mandrel 10 is released, the mold haves are once again joined to manufacture another mandrel 10. This cycle is repeated at a high rate for low cost production.

Several structural features affect production costs. One factor limiting cycle rate is the time for cooling, which in turn is affected by both the quantity and distribution of material. Segments or areas with high concentrations of material generally require greater cooling time because there is less surface area for heat transfer for a given volume of material. Thus, by reducing the material used, the production rates may be increased. Material cost savings is another advantage in addition to this production rate increase.

As illustrated, a typical prior art mandrel is designated by reference numberl 5. There is a high concentration of material at the center 4 of the mandrel 5; cooling at the center requires longer than any other portion. In addition to the material usage and cooling time, the structure of the center 4 contributes to increased scrap rates because of the greater variance in cooling time. If material has not been completely cooled, the force of the ejection pins will cause distortion of the mandrel 5, particularly at the center 4 with the ejection pins striking the end of the shaft 6. An increase in production rates must be balanced against increased scrap.

In contrast to the prior art mandrel 5, the structure of the present invention offers several production cost advantages. Using the trough shaped cavity 22 results in a 50% reduction in material costs and permits higher production rates due to reduced cooling time. The arrangement of the arcuate plates 16, 17, and 18, wall 23 and 24 and the end plates 11 affords the use of thin walls, e.g. 0.030 to 0.045 inches (0.0076 to 0.0114 mm) thick, which cool more uniformly. More uniform cooling allows a further increase in production rates without increasing scrap.

Having described one embodiment of the present invention it will be appreciated that some modification can be made without departing from the spirit or scope of the invention as defined by the appended claims.

I claim:

1. A unitary molded plastic mandrel for supporting a core containing convolutely wound material comprising:

two spaced parallel generally triangular end plates having opposed faces and outer end faces;

a cylindrical stub shaft projecting perpendicular from the outer end face of each end plate, said shafts being axially aligned to define the axis of the mandrel, and arcuate plates defining segments of a cylinder connecting said triangular end plates at corresponding corners of said triangular end plates, said arcuate plates having outer edges parallel to the axis of the mandrel, said arcuate plates being spaced at equal radial distances from said axis and each plate having a rib extending axially along the convex surface of the arcuate plate for engaging the inner cylindrical surface of the core.

2. A mandrel according to claim 1, wherein said ribs are spaced equally along the circumference of the mandrel.

3. A mandrel according to claim 1, wherein said mandrel has an inner supporting framework comprising two diverging walls, parallel to the axis, combining with said arcuate plates to define a trough shaped cavity to reduce the amount of plastic used to manufacture the mandrel; said diverging walls extend between said end plates and diverge from opposed edges of one arcuate plate; each diverging wall is then joined to an edge of one other arcuate plate, said edge being furthest from said opposed edges.

* * * * *